United States Patent [19]

Hayman

[11] 4,332,400

[45] Jun. 1, 1982

[54] POCKET-SIZE ONE-WRITE CHECKBOOK

[75] Inventor: Eric R. Hayman, Maple Glen, Pa.

[73] Assignee: Safeguard Business Systems, Inc., Fort Washington, Pa.

[21] Appl. No.: 137,918

[22] Filed: Apr. 7, 1980

[51] Int. Cl.[3] ..... B41L 1/20; B41L 3/00

[52] U.S. Cl. ..... 282/3 A; 281/5; 282/4; 282/29 B

[58] Field of Search ..... 281/5, 8, 19 R, 21 R, 281/34; 283/8 B, 58, 1 R, 1 A, 18, 21, 57, 58, 66 R; 282/24 R, 29 R, 29 B, 29 A, 9, 9 A, 3 A, 4, 12 R, 13

[56] References Cited

U.S. PATENT DOCUMENTS

| | | | |
|---|---|---|---|
| 2,625,408 | 1/1953 | Hirsch | 282/29 R X |
| 2,869,898 | 1/1959 | Martin | 282/9 R X |
| 3,003,502 | 10/1961 | Zalkind . | |
| 3,161,216 | 12/1964 | Sloves | 281/19 R X |
| 3,290,059 | 12/1966 | Newman | 283/18 X |
| 3,333,869 | 8/1967 | Alexander | 282/24 R |
| 3,645,561 | 2/1972 | Kendall | 282/29 B |
| 3,661,407 | 5/1972 | Warren | 283/66 R X |
| 4,002,356 | 1/1977 | Weidmann | 282/29 B |
| 4,014,566 | 3/1977 | Cantrell | 283/58 X |
| 4,190,268 | 2/1980 | Webster | 283/6 X |

*Primary Examiner*—Paul A. Bell

*Assistant Examiner*—John S. Brown

*Attorney, Agent, or Firm*—Howson and Howson

[57] ABSTRACT

A wallet-sized checkbook particularly suited for use in conjunction with a one-write check record keeping system wherein an entry is made on a journal page simultaneously with the writing of a check. The checkbook enables records of checks written in the field to be subsequently transferred directly on to a one-write journal page. The book comprises a cover having an interior pocket and a writing surface fastened at one end to the inside of the cover. A data sheet of coated release paper overlies the writing surface and releasably carries a series of ink-receptive strips adapted to receive ink from a carbon strip extending along the reverse side of a one-write check. A check is positioned on top of a selected strip on the data sheet by a series of pins which project through pre-punched holes in a widthwise margin of the check. Indicia on the opposite margin of the release paper cooperate with the pins to assist in the check-positioning function. Thus, data written on the front of the check is transferred via the carbon to the underlying strip which can be subsequently peeled from the release sheet and applied at the appropriate line of a journal page to provide an accurate record of the field-written check.

25 Claims, 7 Drawing Figures

POCKET-SIZE ONE-WRITE CHECKBOOK

FIELD OF THE INVENTION

The present invention relates to record-keeping systems, more particularly, the present invention relates to devices which have particular utility in conjunction with one-write check writing and recording systems.

BACKGROUND OF THE INVENTION

For many years, a one-write check writing and recording system has been marketed under the trademark Safeguard by the assignee of the present application. The Safeguard one-write system enables checks to be written and the written data simultaneously entered in a ledger. To this end, the Safeguard one-write system comprises a journal having clamping means, such as illustrated in U.S. Pat. No. 3,003,502, extending lengthwise along the left-hand margin of the journal for releasably connecting a journal entry page having a series of horizontal lines onto which check data is to be transferred. Each check has a horizontal data line onto which data is to be written, such as the date, amount, and payee of the check, and on the reverse side of the check aligned with the data line, a carbon strip is provided. A series of checks overlay the journal page and are releasably secured by the clamping means in overlapping or shingled relation. The checks are shingled in such a manner that the carbon strips overlie the horizontal lines on the journal page. Thus, in writing a check, a bookkeeper simply enters the number, payee and date of the check on its obverse or top surface, and the entered information is immediately transferred via the carbon strip onto the journal page. Widthwise perforations at the left-hand margin of the check enable it to be torn from the journal after it has been written.

While the Safeguard one-write system has been used successfully for many years to provide an accurate record of checks as written from the journal, sometimes it is necessary for checks to be written in the field, i.e., at some location where the journal is not readily available. Customarily, a person does this by tearing several checks out of the journal and carrying them with him to the place where the checks are to be written. If important information on the checks such as the date, payee, check number and amount are lost or misrecorded, serious bookkeeping errors, not to mention the possibility of fraud, can occur. Moreover, even when records are kept properly it is necessary for the information to be given to the bookkeeper for hand-written entry on the journal page after the check writer returns to the office. It should be apparent, therefore, that a device which would facilitate the recording of field-written checks and the subsequent entry of such information into a checkbook journal is highly desirable.

OBJECTS OF THE INVENTION

With the foregoing in mind, a primary object of the present invention is to provide a novel device for use in producing accurate records of field-written checks and affording the transfer of such records into a permanent checking account journal.

It is another object of the present invention to provide a unique portable device for use in writing checks and providing a record of the written checks.

A further object of the present invention is to provide a device which affords temporary records of written checks to be transferred efficiently into a checking account journal page.

A still further object of the present invention is to provide a device which helps to improve the accuracy and reliability of checking account records and which also provides an anti-fraud function.

Yet another object of the present invention is to provide a compact, readily transportable device for use in conjunction with a one-write check record keeping system to enable data from checks written in the field to be subsequently transferred easily into a conventional one-write checking account journal.

SUMMARY OF THE INVENTION

More specifically, the present invention provides a compact, wallet-like device which is particularly suited for use in conjunction with a one-write checking account journal having a page with a series of lines on which data is imprinted from a carbon strip on the reverse side of a check shingled and clamped with like checks in the journal. The device comprises an elongated data sheet having a plurality of data-receiving record strips disposed in parallel relation on the data sheet. Means is provided for releasably securing the record strips to the data sheet, and means is provided for positioning on the data sheet a check having a carbon strip with the carbon strip overlying one of the data-receiving record strips. Thus, when data is entered on the front of the check overlying the carbon strip, the data is transferred directly onto the underlying record strip on the data sheet. The record strip can then be subsequently removed from the data sheet for entry elsewhere.

Preferably, a cover having an interior pocket for containing blank checks and a writing surface underlies the data sheet and all are bendable to enable the assembly to be folded in half and secured in its folded configuration for compact carrying. Also, the data sheet is preferably provided with a release coating which cooperates with adhesive carried on the reverse sides of the record strips to allow the strips to be peeled off the data sheet and secured by the same adhesive to a page in the one-write journal.

Preferably, the check positioning means includes a member having a series of pins protruding therefrom along the left-hand margin of the cover, the pins cooperating with holes punched in the check at pre-determined locations so as to dispose the carbon strip of the check above any selected one of the record strips on the data sheet. Indicia is also provided on the right-hand widthwise margin of the data sheet in endwise alignment with the strips to facilitate positioning of the checks.

With this structure, an accurate record of a check written in the field is produced, and the record can be transferred to a more permanent checking account journal.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
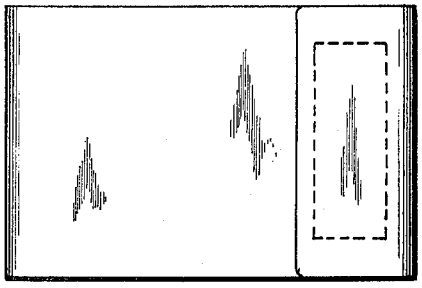
FIG. 1 is a plan view of a device embodying the present invention, the view illustrating the device folded and secured in its compact carrying configuration.
Figure 2:
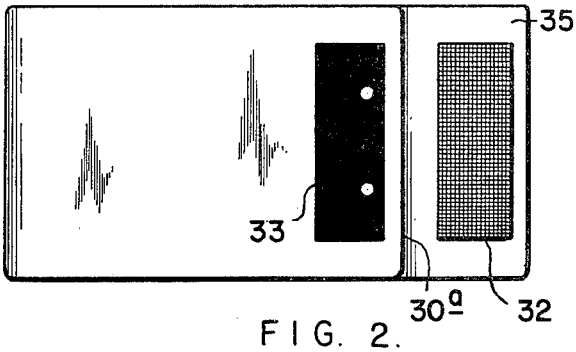
FIG. 2 is a view similar to FIG. 1 but illustrating the means for fastening the device in its folded configuration.

Referring now to the drawings, FIG. 1 illustrates a wallet-like, check writing and recording device 10 which embodies the present invention. The device 10 is particularly suited for use in conjunction with a conventional check writing and record keeping system, such as the one-write check writing and record keeping journal 11 illustrated in FIG. 5. The journal 11 is typical of a one-write system marketed under the trademark Safeguard by the assignee of the present application.

The journal 11 comprises means providing a writing surface 12 on which is placed a data entry sheet 13 which is held in place along its left-hand margin by a releasable clamping assembly 14. The clamping assembly 14 has a series of pins 14' which project upwardly through a series of holes in the left-hand margin of the data sheet 13 to position the data sheet 13 when it is placed on the pad 12 with its holes impaled by the pins 14'. A clamping assembly 14 which has found particular utility in conjunction with the one-write journal is disclosed in U.S. Pat. No. 3,003,502.

Figure 5:
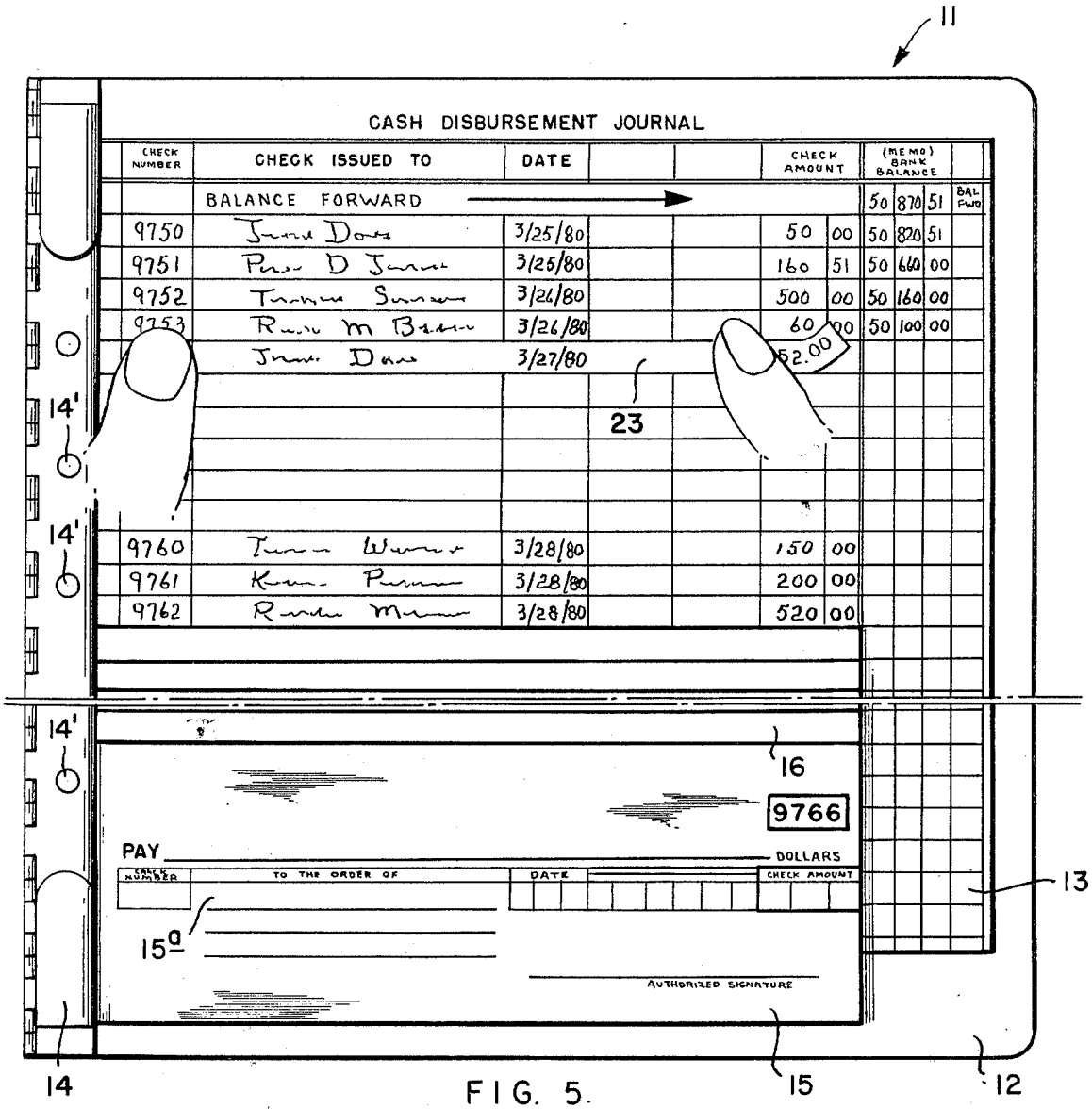
FIG. 5 is a vertically fore-shortened view of a one-write checking account journal illustrating the manner in which it cooperates with certain elements of the present invention.

In the data sheet illustrated in FIG. 5, the sheet 13 is divided into a series of vertical columns headed, from left to right: check number, check issued to, date, check amount, etc. The data sheet 13 is also divided by a series of lines extending horizontally onto which data regarding checks is applied. For instance, on the topmost horizontal line, it would appear that check number 9750 was written to a certain person on Mar. 25, 1980 in the amount of $50.00.

In the conventional one-write system, a series of checks 15, 16 are releasably secured at their left-hand margins by the clamping assembly 14. As illustrated in FIG. 5, the checks 15, 16, etc. are fastened in overlapping or shingled relation on top of the data sheet 13. Each check, such as the check 15, has a horizontally disposed data line 15*a* on which information, such as the check number, payee, date, and amount may be written manually. The check 15 has on its reverse side an elongated, relatively-narrow strip of pressure-sensitive carbon which is aligned with the data strip 15*a*, such as the carbon strip 20 on the reverse side of the check 21 illustrated in FIG. 3. The checks 15, 16 are offset from one another a distance corresponding to the width of a horizontal line on the journal page 13.

In writing a check with the conventional journal 11, shingled checks below the check on which data is to be written are simply folded leftward to expose the data line of the check to allow the appropriate data to be entered on the data line. After the check has been written, it is torn from the clamping assembly 14 along a line of perforations, such as the line 22 of check 21 in FIG. 3. This check writing and recording function continues, each check being numbered sequentially to correspond with sequential lines on the data sheet 13 in the journal 11.

The check writing and record keeping system described thus far functions entirely satisfactorily as long as checks are written from a central office location where the journal 11 is kept. In the event, however, that it is necessary to write checks at some other location, people utilizing the conventional Safeguard one-write system usually simply tear several checks from the clamping assembly 14 and carry them with them for writing at some field location such as on a trip, etc., because the conventional journal 11 is relatively large and is not readily portable. When the checks are removed from the journal 11, a series of blank horizontal lines are left corresponding to those checks which have been removed. For instance, as illustrated in FIG. 5, a series of blank horizontal lines are left between check numbers 9754 and 9760, corresponding to a series of six checks which have been removed from the journal 11. Other checks numbered 9760–62 represent checks which have been written subsequent to the removal of the eight checks.

As noted heretofore, when checks are written in the field, it is necessary for information about the checks to be recorded on a separate piece of paper which is subsequently delivered to a bookkeeper for hand entry onto the data page 13 of the conventional one-write journal 11. Because of the possibility of error in recording the data, and the possibility of fraud, this system for recording and transferring field written check data has not been entirely satisfactory.

According to the present invention, the wallet-like check writing and recording device 10 is designed to cooperate with the one-write journal 11 to enable accurate field records of written checks to be made and to be subsequently transferred efficiently and accurately onto the data sheet 13 of the one-write journal 11.

Figure 7:
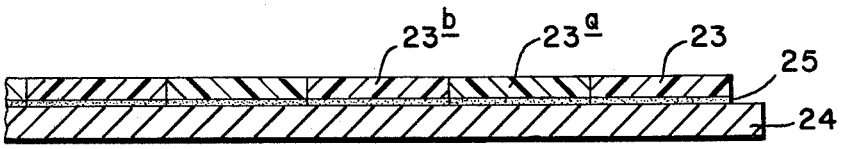
FIG. 7 is a greatly enlarged sectional view taken on line 7—7 of FIG. 3.

This is accomplished by causing pertinent data regarding a check to be imprinted in the field on a strip, such as the strip 23 (FIG. 5) which strip can be subsequently adhesively secured in place on the data sheet 13 at the appropriate line thereon. To this end, the device 10 has a rectangular data sheet 24 (FIGS. 3 and 4) which is sized slightly larger than the size of the check 21. A series of elongated strips 23, 23*a*, 23*b*, etc. are carried on the data sheet 24 in parallel relation extending lengthwise from left to right. As illustrated in FIG. 7, the strips 23–23*b* are preferably fabricated of Mylar and have upper surfaces which have been treated so as to receive ink from the carbon strip 20. The undersurfaces of the strips carry a layer of adhesive 25, and the data sheet 24 has a release coating which confronts the adhesive 25 so that the adhesive 25 has a greater affinity for the data strips than for the release coating. This permits the strips to be peeled from the data sheet 24. Preferably, the data sheet 24 also has a column 28 of indicia, in the present instance, numerical characters, which extend widthwise along its right-hand margin. See FIGS. 3 and 4. The numerical characters are aligned endwise with the strips 23–23*b* and cooperate in a manner to be described to assist in the positioning of the check 21 during writing.

Figure 3:
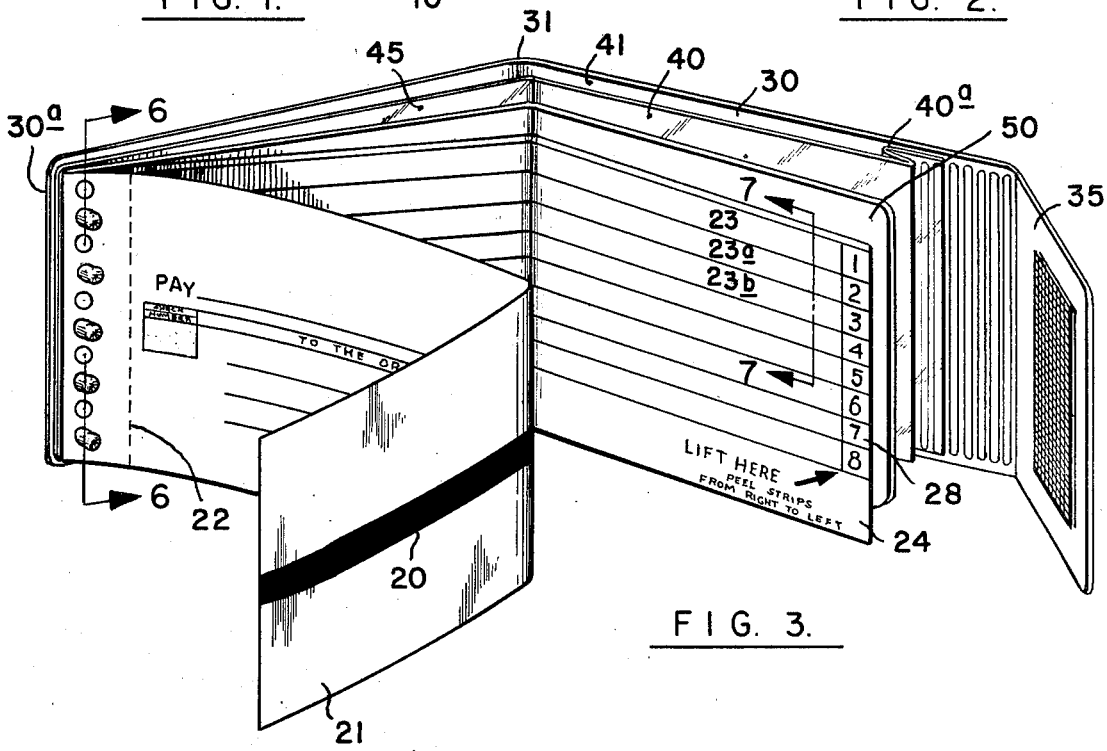
FIG. 3 is an enlarged, exploded perspective view of the device.

Referring now to FIG. 3, the check writing and record keeping device 10 has an elongated rectangular cover 30 having a lengthwise dimension which is substantially greater than its widthwise dimension, both dimensions being greater than corresponding dimensions of a check, such as the check 21. The cover 30 is preferably fabricated of a pliable material such as vinyl, and the material may have a surface texture to provide a handsome, leather-like outside appearance. The cover 30 is sufficiently pliable as to be bendable about a transverse line 31 adjacent its midpoint and thereby to be folded into the configuration illustrated in FIG. 1.

The cover 30 is maintained in its folded configuration by the cooperation of a Velchro fastening assembly which comprises a patch 32 of hooks which cooperate with a similarly sized patch of fibers 33 in a well-known manner. Preferably, the hook patch 32 is fastened on the inside of the right-hand widthwise margin or flap 35 of the cover 30, and the fabric patch 33 is fastened on the opposite side of the cover on the margin thereof remote from the hook patch 32. Thus, the flap 35 mounting the hook patch 32 can be folded across the free end 30*a* of the cover 30 and pressed against the fiber patch 33 to secure the device 10 in the configuration illustrated in FIG. 1 for compact carrying.

In order to store a series of blank checks within the device 10, a rectangular sheet of flexible plastic 40 is fastened to the cover 30 along its left-hand, bottom and right-hand margins as by heat sealing, gluing or the like. Preferably, the plastic sheet 40 has a corrugation or fold 40*a* extending widthwise adjacent the flap 35. The plastic sheet 40 thereby cooperates with the cover 30 to provide a pocket 41 sized sufficiently large as to receive a series of checks without folding. The pocket 41 is also capable of receiving sheets of paper interposed between the checks to prevent the carbon strips on the reverse sides thereof from rubbing off on the front sides of the checks thus stored, or the checks can be folded with their carbon strips inward and carried in the pocket 41.

According to the present invention, means is also provided for releasably retaining the data sheet 24 inside the cover 30 and properly positioning the check 21 relative thereto. To this end, the left-hand widthwise margin of the data sheet 24 is provided with a series of pre-punched holes 24*a*, 24*b*, etc., selected ones of which are impaled by pins 25, 25*a*, 25*b*, etc., which protrude upwardly from the cover 30. Although the illustrated pins are metal and are staked to the cover 30, they may be molded of plastic integral with the board if desired. Thus, the data sheet 24 can be simply and releasably fastened inside the cover 30 by impaling it on the pins 25–25*b*.

Figure 6:
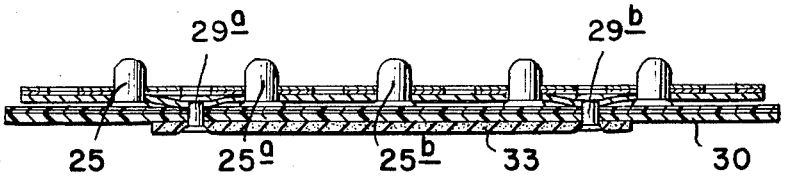
FIG. 6 is an enlarged sectional view taken on line 6—6 of FIG. 3.

In order to provide a backup during the writing of checks, means providing a writing board or surface 50 is mounted inside the cover 30 underneath the data sheet 24. As best seen in FIG. 3, the writing surface 50 is fastened along its left-hand margin to the cover 30 by a pair of rivets 29*a* and 29*b* which extend through the cover 30, the Velchro fiber pad 33, and the writing surface 50 in the manner illustrated in FIG. 6. The writing surface 50 has score means providing a transverse hinge 50*a* enabling it to be folded widthwise. Preferably, the writing surface 50 is of relatively stiff plastic material to provide a rigid backing surface during writing.

Figure 4:
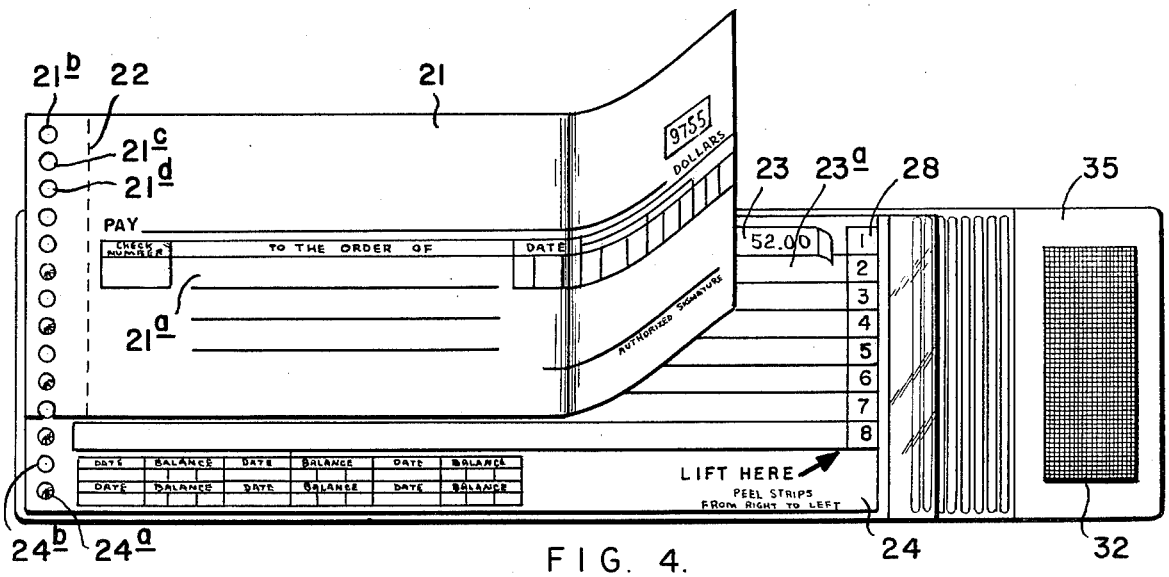
FIG. 4 is a view of the device illustrated in FIG. 3 immediately prior to writing a check.

In writing a check, such as the check 21 illustrated in FIG. 4, the check 21 is placed over the data sheet 24 so that its data entry line 21*a*, and the corresponding carbon strip 20 on the reverse side thereof, overlays one of the record strips, such as the strip 23*a*. In order to position the check 21 properly so that its data strip 21*a* is aligned accurately with the underlying record strip 23*a*, the check 21 is provided with a series of pre-punched holes 21*b*–21*d*, etc., extending vertically in its left-hand widthwise margin. The spacings between the holes are such as to allow them to be impaled on selected ones of the pins 25–25*b*, in a manner such as illustrated in FIG. 4. Preferably, the column of characters 28 on the right-hand widthwise margin of the data sheet 24 are used as a guide in aligning the data strip 21*a* with the record strip 23*a* before the check 21 is impaled on the pins 25–25*b*. After the check has been properly placed on the data sheet 24, appropriate information can be entered on the data line 21*a*, including the check number, payee, date, amount, etc. This information is preferably entered by means of a ball-point pen or other instrument by which sufficient pressure can be applied to the data line 21*a* so as to cause carbon carried in the strip 20 on the reverse side of the check 21 to be imprinted on the upper surface of the data strip 23*a*.

After the desired number of checks have been written and information imprinted on the various record strips 23–23*b* the data sheet 24 may be removed from the device 10 and handed to a bookkeeper for entry in the journal 11. The bookkeeper accomplishes this task readily by peeling the data strips 23–23*b* from right to left, gripping the strips adjacent their ends between fingers on both hands, and applying the strips onto the corresponding lines on the data sheet 13 in the journal 11. For instance, the uppermost record strip 23 is illustrated partially peeled from its right-hand end in FIG. 4. After it has been peeled fully from the record sheet 24, the bookkeeper places the strip 23 onto the appropriate horizontal line on the data page 13 of the journal 11 and enters the information by smoothing the strip from left to right in the manner illustrted in FIG. 5. This is continued until all of the record strips corresponding to the field written checks have been transferred onto the data page 13. It is noted that the adhesive on the reverse side of the data strips tends to set up after a period of time to permanently secure the strips to the journal page 13. The adhesive, however, does not set up immediately so that in the event that a data strip is applied onto the wrong line on the journal data page 13, it could be removed and replaced at a proper location if done promptly.

In view of the foregoing, it should be apparent that the present invention now provides a readily portable wallet-sized device which is particularly suited for use in conjunction with a one-write check writing and recording journal. The device of the present invention is relatively simple to use, provides an accurate readily transferable record of field written checks, and enables the records to be transferred efficiently into the one-write journal.

While a preferred embodiment of the present invention has been described in detail, various modifications, alterations and changes may be made without departing from the spirit and scope of the present invention as defined in the appended claims.

I claim:

1. A device for use in producing a field record of data entered on a check, comprising:

means providing a portable writing surface, an elongated data sheet overlying said writing surface, a plurality of removable data receiving record strips carried on said data sheet in parallel relation, means for releasably securing said record strips to said data sheet, at least one check having a pressure-sensitive ink-transfer strip on its underside adapted to be placed on top of said data sheet, and means extending along a margin of said writing surface for releasably mounting said check on said data sheet with the pressure-sensitive ink-transfer strip of the check overlying one of said data-receiving record strips, whereby data placed on the check is transferred simultaneously onto the underlying record strip which can be subsequently removed from the record sheet.

2. A device according to claim 1 wherein said releasable securing means includes a layer of adhesive on the undersides of said strips and a layer of release coating on said data sheet, whereby the strips can be peeled from the data sheet and adhesively applied elsewhere.

3. A device according to claim 1 wherein said check and data sheet have lengthwise and widthwise dimensions, said ink-transfer strip extends lengthwise of said check and said data strips extend lengthwise of said data sheet, and said releasable mounting means extends along at least one widthwise dimension of the data sheet for aligning said check with said one of said lengthwise extending strips.

4. A device according to claim 3 wherein said releasable mounting means for said check includes a series of pins protruding through said data sheet and the check margin.

5. A device according to claim 3 including indicia means carried by said data sheet along at least one widthwise dimension thereof in endwise alignment with said record strips to aid in positioning said check over said one data-receiving strip.

6. A device according to claim 5 wherein said indicia means includes characters disposed in a column on one edge margin of said data sheet.

7. A device according to claim 1 including a substantially flat pad underlying said data sheet to provide said writing surface under said record strips.

8. A device according to claim 7 wherein said writing surface means is relatively rigid and has a transverse hinge affording widthwise folding.

9. A device according to claim 1 including a cover underlying said writing surface and adapted to be folded transversely with said data sheet into a wallet-like configuration, and cooperating means carried on said cover for releasably fastening said cover in its folded configuration.

10. A device according to claim 9 including means providing a pocket on the inside of said cover for storing a quantity of blank checks.

11. A device according to claim 9 wherein said cooperating cover fastening means includes complementary Velchro-type fastening strips, one fastening strip being located on an inside widthwise margin of the cover and the other fastening strip being located on the opposite outside widthwise margin.

12. A device according to claim 1 including an elongated cover underlying said data sheet, and including means carried by said cover for releasably connecting said data sheet to said cover along its widthwise margin.

13. A device according to claim 12 wherein said releasable check mounting means includes a series of pins for impaling both said data sheet and said check along their widthwise margins.

14. A device according to claim 13 wherein said means providing a writing surface carried by said cover underneath said data sheet is permanently connected to said cover along the widthwise margin where said pins are located.

15. A device according to claim 14 including a column of characters carried on said data sheet remote from said pins in endwise alignment with said record strips to assist in positioning said check on said data sheet.

16. A device according to claim 15 wherein said data strip releasable securing means includes a layer of adhesive on the undersides of said strips and a layer of release coating on said data sheet, whereby the strips can be peeled from the data sheet and adhesively applied elsewhere.

17. A device for use in producing a field record of data directly from a check having a pressure-sensitive ink-transfer strip on its reverse side and affording direct transfer of the field record from the device to another record, comprising:

an elongated rectangular cover having widthwise margins, a pocket carried by said cover for storing checks, a writing surface carried by said cover over said pocket, a data sheet overlying said writing surface, said data sheet having a plurality of elongated data-receiving record strips disposed thereon in parallel relation, a layer of adhesive on the undersides of said strips, and a release layer on said data sheet affording peeling of said strips therefrom, a check disposed on said data sheet with the ink-transfer strip of the check overlying one of said record strips, and means extending along one widthwise margin of the cover for releasably connecting said record sheet to said cover and for releasably fastening said check with its ink-transfer strip in said overlying relation with said record strip, whereby data applied to the check is transferred directly onto the record strips which can be peeled from the record sheet and transferred elsewhere.

18. A device according to claim 17 wherein said record sheet and check releasable fastening means includes a series of holes in one of the widthwise margins of the check and the data sheet and a series of pins protruding through said holes.

19. A device according to claim 18 wherein said data sheet has a lengthwise dimension greater than the lengthwise dimension of the check, and including a column of indicia disposed on the widthwise margin of said data sheet remote from said fastening means, said indicia including a series of characters corresponding to the series of record strips and being located in endwise alignment with the record strips to facilitate placement of checks on the data sheet.

20. A device according to claim 19 wherein said cover, pocket, writing surface means, and data sheet are foldable transversely, and including means releasably fastening the cover in its folded configuration.

21. For use with a one-write check journal having an entry page with a series of sequential lines adapted to receive imprints from the reverse sides of checks to provide a record of the written checks and having means for releasably securing a series of sequentially-numbered checks having imprint transfer lines overlying corresponding sequential lines of said entry page, a device for producing records of selected field-written checks of said series and affording transfer of said field-written check records to said entry page of said one-write journal, said device comprising:

means providing a portable writing surface, a data sheet overlying said writing surface, a plurality of imprint-receiving strips overlying said data sheet, means for releasably securing said strips to said data sheet and affording permanent securement to said journal entry page, at least one check having a pressure-sensitive ink-transfer strip on its underside adapted to be placed on top of said data sheet, and means for releasably mounting at least one of said checks with its imprint-transfer line in overlapping alignment with one of said strips, whereby information applied to the check in the field is transferred onto the underlying strip which can be subsequently removed from the data sheet and applied onto the page of the one-write journal at the line corresponding to the number of the check.

22. A device according to claim 21 including a cover with a blank check receiving pocket underlying said portable writing surface and adapted to be folded over onto itself.

23. A device according to claim 21 wherein said data sheet has an adhesive release coating on its upper surface and said releasable strip securing means includes a layer of adhesive on the undersides of the strips, said adhesive having a greater affinity for the strips than for the release coating.

24. A device according to claim 21 wherein said releasable mounting means includes a member having a series of pins adapted to engage a widthwise margin of said check and including a column of characters on said data sheet disposed in endwise alignment with said record strips to aid in positioning said check on said data sheet.

25. A device according to claim 21 including means providing a transverse hinge in said writing surface to afford folding thereof on itself.

* * * * *